US005967075A

United States Patent [19]

Johansen

[11] Patent Number: 5,967,075

[45] Date of Patent: Oct. 19, 1999

[54] SPRING LOADED MOORING DEVICE

[76] Inventor: Roy D. Johansen, 1421 Roper Mountain Rd. #347, Greenville, S.C. 29615-5149

[21] Appl. No.: 09/086,453

[22] Filed: May 28, 1998

[51] Int. Cl.[6] ..... B63B 21/00

[52] U.S. Cl. ..... 114/230.1; 114/218; 43/21.2; 248/538

[58] Field of Search ..... 114/230.26, 218, 114/230.1; 43/21.2; 248/538, 539

[56] References Cited

U.S. PATENT DOCUMENTS

| | | | |
|---|---|---|---|
| 4,297,963 | 11/1981 | Beacom | 114/218 |
| 5,120,016 | 6/1992 | Dysarz | 248/539 |
| 5,625,974 | 5/1997 | Demaio | 43/21.2 |
| 5,690,042 | 11/1997 | Bentley | 114/218 |

*Primary Examiner*—Jesus D. Sotelo

[57] ABSTRACT

A device is provided including an eyelet with a rod having a first end connected thereto. A cross bar is coupled at a central extent thereof to a second end of the rod. A spring mechanism is adapted for being urged toward the cross bar with a recipient surface situated therebetween.

8 Claims, 3 Drawing Sheets

SPRING LOADED MOORING DEVICE

BACKGROUND OF THE INVENTION

1. Field of the Invention

The present invention relates to mooring devices and more particularly pertains to a new spring loaded mooring device for attaching a mooring device or other type of supporting device to a dock or the like.

2. Description of the Prior Art

The use of mooring devices is known in the prior art. More specifically, mooring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art mooring devices include U.S. Pat. No. 4,899,680; U.S. Pat. No. 4,297,963; U.S. Patent Des. 321, 470; U.S. Pat. No. 3,473,505; U.S. Pat. No. 849,023; and U.S. Patent Des. 273,176.

In these respects, the spring loaded mooring device according to the present invention substantially departs from the conventional concepts and designs of the prior art, and in so doing provides an apparatus primarily developed for the purpose of attaching a mooring device or other type of supporting device to a dock or the like.

SUMMARY OF THE INVENTION

In view of the foregoing disadvantages inherent in the known types of mooring devices now present in the prior art, the present invention provides a new spring loaded mooring device construction wherein the same can be utilized for attaching a mooring device or other type of supporting device to a dock or the like.

The general purpose of the present invention, which will be described subsequently in greater detail, is to provide a new spring loaded mooring device apparatus and method which has many of the advantages of the mooring devices mentioned heretofore and many novel features that result in a new spring loaded mooring device which is not anticipated, rendered obvious, suggested, or even implied by any of the prior art mooring devices, either alone or in any combination thereof.

To attain this, the present invention generally comprises an eyelet with an annular configuration and residing within a first plane. It should be noted that the eyelet has a predetermined diameter. Note FIGS. 7–9. Also included is a linear rod having a first end connected to an outer edge of the eyelet. The rod extends from the eyelet along a line which resides in a second plane that forms an angle ranging from 1 degree to 90 degrees with the first plane. As shown in the Figures, the rod has a length which is about twice the diameter of the eyelet. Next provided is a linear cross bar with a length about ½ that of the rod. The cross bar is coupled at a central extent thereof to a second end of the rod. Further, the cross bar resides within the second plane. Ideally, the cross bar includes a pair of flared, sharpened spurs each integrally mounted to ends of the cross bar and extending perpendicularly therefrom in parallel with the eyelet. In the preferred embodiment, the eyelet, rod, and cross bar are formed of a rigid metal with a constant circular cross-section. Finally, a plate is provided with a planar circular configuration. A concentric aperture is formed in the plate for being slidably received on the rod. Associated therewith is a coil spring encompassing the rod between the eyelet and the plate for urging the plate against the cross bar.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spring loaded mooring device apparatus and method which has many of the advantages of the mooring devices mentioned heretofore and many novel features that result in a new spring loaded mooring device which is not anticipated, rendered obvious, suggested, or even implied by any of the prior art mooring devices, either alone or in any combination thereof.

It is another object of the present invention to provide a new spring loaded mooring device which may be easily and efficiently manufactured and marketed.

It is a further object of the present invention to provide a new spring loaded mooring device which is of a durable and reliable construction.

An even further object of the present invention is to provide a new spring loaded mooring device which is susceptible of a low cost of manufacture with regard to both materials and labor, and which accordingly is then susceptible of low prices of sale to the consuming public, thereby making such spring loaded mooring device economically available to the buying public.

Still yet another object of the present invention is to provide a new spring loaded mooring device which provides in the apparatuses and methods of the prior art some of the advantages thereof, while simultaneously overcoming some of the disadvantages normally associated therewith.

Still another object of the present invention is to provide a new spring loaded mooring device for attaching a mooring device or other type of supporting device to a dock or the like.

Even still another object of the present invention is to provide a new spring loaded mooring device that includes an eyelet with a rod having a first end connected thereto. A cross bar is coupled at a central extent thereof to a second end of the rod. A spring mechanism is adapted for being urged toward the cross bar with a recipient surface situated therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
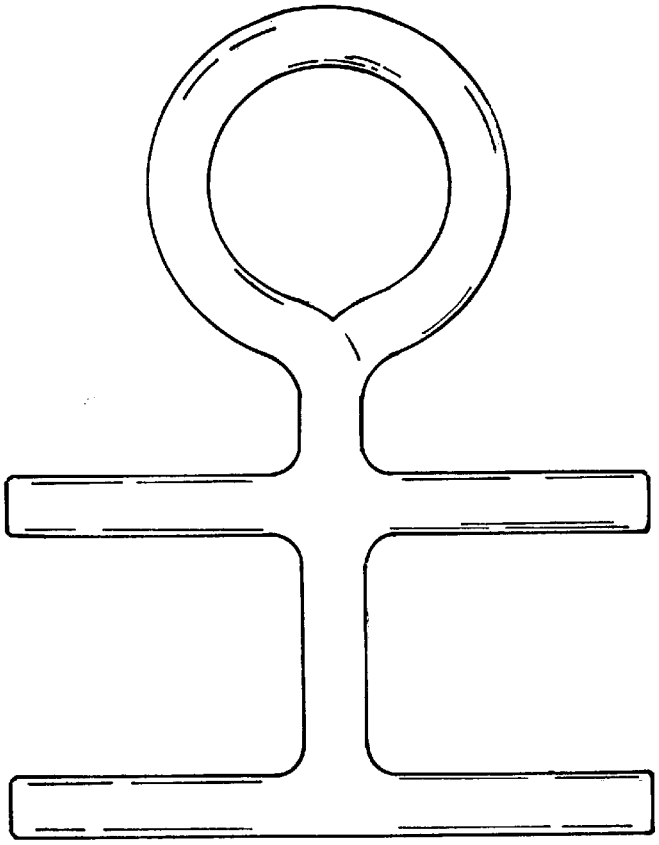
PRIOR ART FIG. 1
FIGS. 1 & 2 are illustrations of the prior art associated with the present invention.
Figure 2:
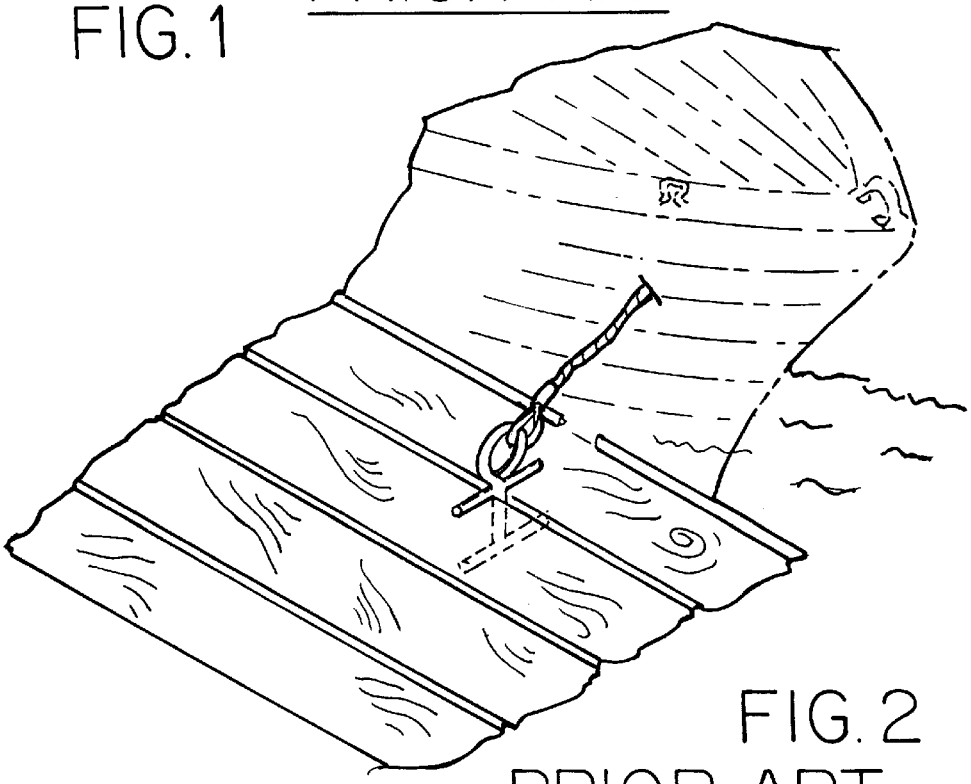
FIG. 2 PRIOR ART
Figure 3A:
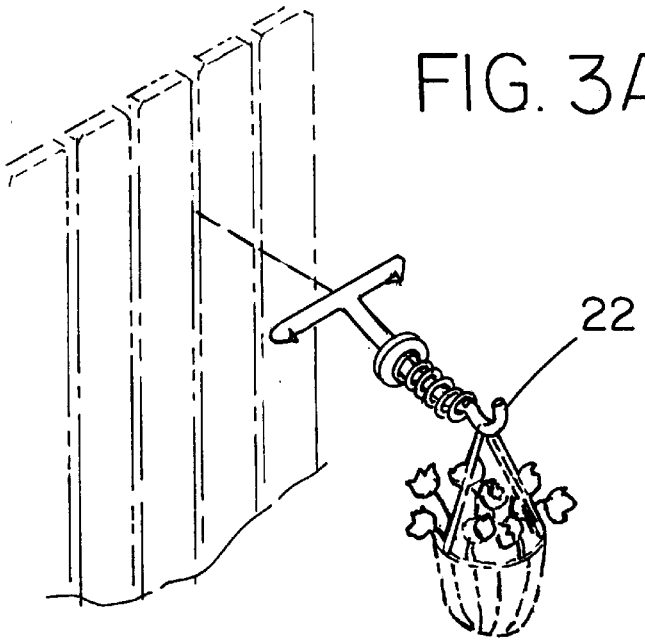
FIGS. 3A & 3B are a perspective views of the hook embodiments of the present invention.

With reference now to the drawings, and in particular to FIGS. 1 through 9 thereof, a new spring loaded mooring device embodying the principles and concepts of the present invention and generally designated by the reference numeral 10 will be described.

The present invention, designated as numeral 10, includes an eyelet 12 with an annular configuration and residing within a first plane. Note FIGS. 7–9.

Also included is a linear rod 14 having a first end connected to an outer edge of the eyelet. The rod extends from the eyelet along a line which resides in a second plane that forms an angle ranging from approximately 1 degree to approximately 90 degrees with the first plane. As shown in the Figures, the rod has a length which is about twice the diameter of the eyelet.

Next provided is a linear cross bar 16 with a length about ½ that of the rod. The cross bar is coupled at a central extent thereof to a second end of the rod. Further, the cross bar resides within the second plane. Ideally, the cross bar includes a pair of flared, sharpened spurs 17 each integrally mounted to ends of the cross bar and extending perpendicularly therefrom in parallel with the eyelet.

Figure 9:
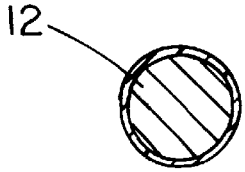
FIG. 9 is a cross-sectional view of the present invention taken along line 9—9 shown in FIG. 7.
Figure 3B:
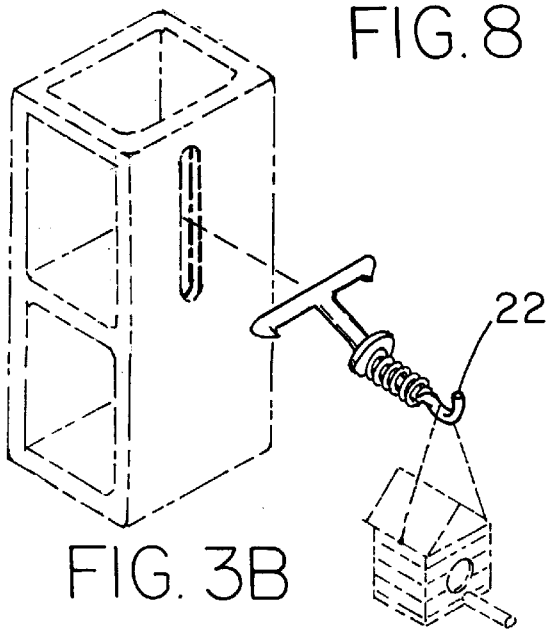

In the preferred embodiment, the eyelet, rod, and cross bar are formed of a rigid metal with a constant circular cross-section, as shown in FIG. 9.

Finally, a plate 18 is provided with a planar circular configuration having a diameter slightly less than that of the eyelet. A concentric aperture is formed in the plate for being slidably received on the rod. Associated therewith is a coil spring 20 encompassing the rod between the eyelet and the plate for urging the plate against the cross bar.

By this structure, the cross bar may be inserted between a pair of adjacent planks. Thereafter, the cross bar is rotated and maintained in place by way of the plate and spring. The eyelet, or supporting means, may thus be secured to the planks which may constitute a portion of a dock, fence, table or the like.

Figure 4:
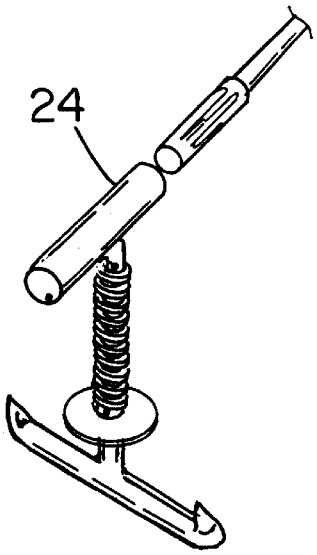
FIG. 4 is a perspective view of the fishing pole supporting embodiment of the present invention.
Figure 5:
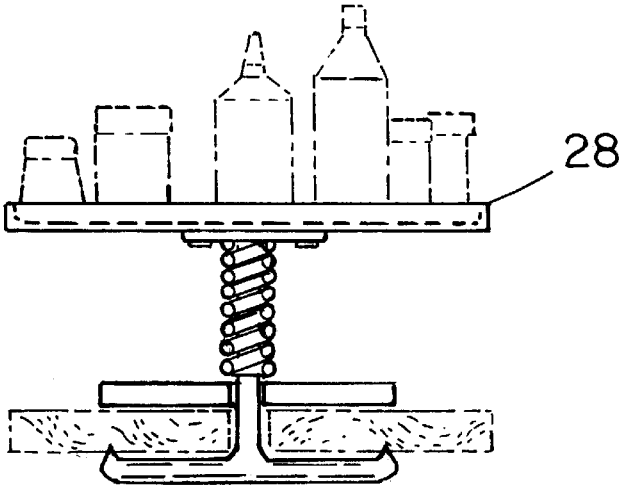
FIG. 5 is a side view of the lazy susan embodiment of the present invention in use.
Figure 6:
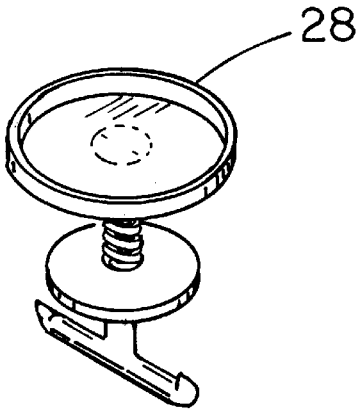
FIG. 6 is a perspective view of the embodiment of the present invention shown in FIG. 5.
Figure 7:
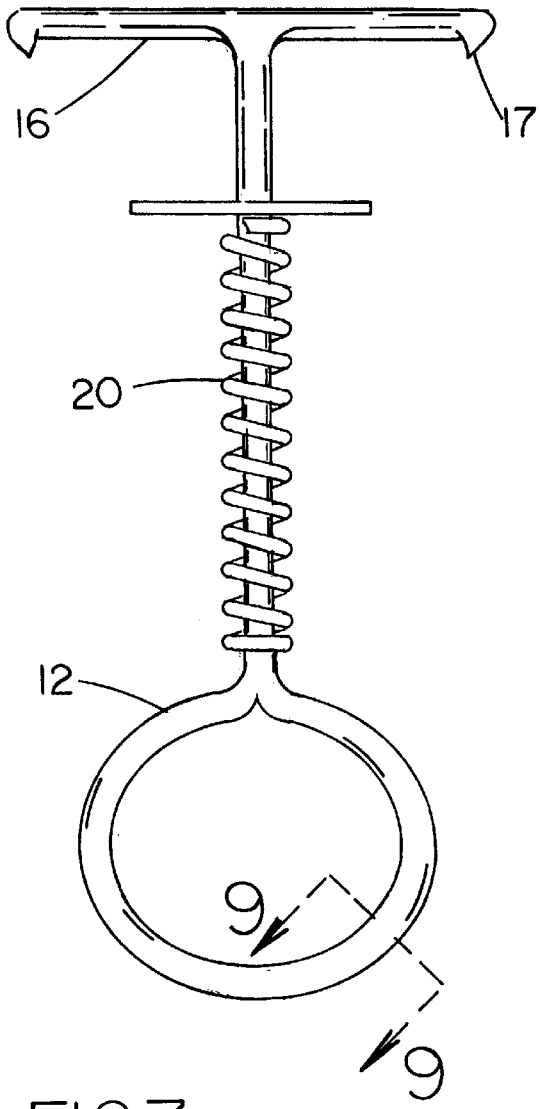
FIG. 7 is a front view of the mooring embodiment of the present invention.
Figure 8:
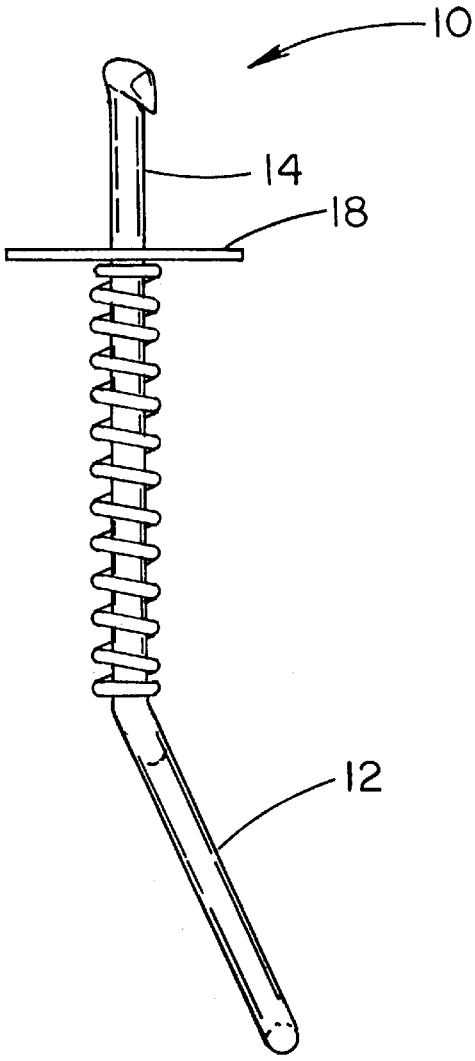
FIG. 8 is a side view of the mooring embodiment of the present invention.

In various alternate embodiments shown in FIGS. 3–6, the supporting means may take alternate forms such as a hook 22 for hanging a plant or the like on a fence. Note FIG. 3A. FIG. 3B shows a similar embodiment being used in conjunction with a cinder block or the like. As shown in FIG. 4, the supporting means includes an angled tube 24 for releasably receiving a fishing pole and securing the same to a dock. Lastly, the supporting means may further take the form of a lazy susan 28 for being secured on a table.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device comprising, in combination:

a lazy Susan having an upper surface for resting items thereon, a generally circular outer perimeter, and a perimeter lip upwardly extending around the outer perimeter of the lazy Susan;

a linear rod having a first end connected to a center of the lazy Susan and downwardly extending perpendicularly therefrom, the rod having a length;

a linear cross bar with a length about ½ that of the rod, the cross bar coupled at a central extent thereof to a second end of the rod, the cross bar extending perpendicular to the rod, the cross bar including a pair of flared, sharpened spurs each integrally mounted to ends of the cross bar and extending perpendicularly therefrom in parallel with the eyelet;

said rod and cross bar being formed of a rigid metal with a constant circular cross-section; and a plate with a planar circular configuration and having a concentric aperture formed therein for being slidably received on the rod; and a coil spring encompassing the rod between the the lazy Susan and the plate for urging the plate against the cross bar.

2. A device comprising:

supporting means for supporting an entity;

a rod having a first end connected to the supporting means;

a linear cross bar coupled at a central extent thereof to a second end of the rod;

spring means for being urged toward the cross bar with a recipient surface situated therebetween; and wherein the supporting means includes a lazy Susan.

3. A device as set forth in claim 2 and further including a pair of flared ends situated on ends of the cross bar.

4. A device as set forth in claim 2 wherein the spring means includes a plate slidably received on the rod and a coil spring encompassing the rod between the supporting means and the plate for urging the plate against the cross bar.

5. A device as set forth in claim 2, wherein the lazy Susan has a planar upper surface for resting items thereon.

6. A device as set forth in claim 2, wherein the lazy Susan has a generally circular outer perimeter and a perimeter lip upwardly extending around the outer perimeter.

7. A device as set forth in claim 2, wherein the first end of the rod is connected to a center of the lazy Susan and downwardly extends perpendicularly from the lazy Susan.

8. A device as set forth in claim 2, wherein the cross bar is extended perpendicular to the rod.

* * * * *